US005522658A

United States Patent [19]

John

[11] Patent Number: 5,522,658

[45] Date of Patent: Jun. 4, 1996

[54] APPARATUS FOR MIXING LIGHTWEIGHT CONCRETE

[76] Inventor: Stanley K. John, 6847 S. Rainbow Rd., Buckeye, Ariz. 85326

[21] Appl. No.: 440,999

[22] Filed: May 15, 1995

[51] Int. Cl.[6] ..... B28C 5/04; B28C 7/12

[52] U.S. Cl. ..... 366/15; 366/18; 366/19

[58] Field of Search ..... 366/14, 15, 16, 366/18, 19, 40, 141

[56] References Cited

U.S. PATENT DOCUMENTS 4,895,450 1/1990 Holik ..... 366/18

FOREIGN PATENT DOCUMENTS 2171091 8/1986 United Kingdom ..... 366/14

*Primary Examiner*—David Scherbel
*Assistant Examiner*—Randall E. Chin
*Attorney, Agent, or Firm*—H. Gordon Shields

[57] ABSTRACT

Apparatus for mixing lightweight concrete includes a main mixing unit which receives volumetrically measured dry aggregate material including polystyrene and wet material which includes cement measured by weight and water measured volumetrically. The wet and dry materials are mixed in the main mixing unit prior to the mixed material being poured into molds for curing.

11 Claims, 2 Drawing Sheets

APPARATUS FOR MIXING LIGHTWEIGHT CONCRETE

BACKGROUND OF THE INVENTION

1. Field of the Invention

This invention relates to lightweight concrete, and, more particularly to apparatus for mixing lightweight concrete.

2. Description of the Prior Art

U.S. Pat. No. 4,895,450 discloses apparatus for weighing, measuring, and mixing lightweight concrete. The apparatus utilizes combinations of weighing and measuring of the various ingredients, namely cement, water, and polystyrene aggregate. The '450 apparatus also utilizes scrap material, hydrated cement, as aggregate material.

An inherent problem with the '450 apparatus is in the requirement for both weighing and measuring by volume the dry material being mixed with water and cement. The apparatus of the present invention recycles polystyrene material by separating the polystyrene material from cement dust, and thus substantially eliminates the requirement for weighing the dry material.

SUMMARY OF THE INVENTION

The apparatus described and claimed herein comprises apparatus for mixing lightweight concrete, which lightweight concrete includes cement, water, and polystyrene (styrene) aggregate. The apparatus volumetrically measures styrene aggregate and mixes it with cement, which is weighed, and fresh and recycled water, which is measured volumetrically. The ingredients, as brought together in a main mixing unit, are appropriately mixed before being moved into molds for curing.

Among the objects of the present invention are the following:

To provide new and useful mixing apparatus;

To provide new and useful apparatus for mixing lightweight concrete;

To provide new and useful apparatus for mixing lightweight concrete utilizing volumetrically measured aggregate;

To provide new and useful mixing apparatus for lightweight concrete using volumetrically measured polystyrene aggregate, fresh and recycled water measured volumetrically, and cement measured by weight; and To provide new and useful apparatus for mixing lightweight concrete in which scrap material including polystyrene and hydrated cement are separated and reused.

DESCRIPTION OF THE PREFERRED EMBODIMENT

Lightweight concrete utilizes polystyrene, hereinafter referred to simply as "styrene" as a primary aggregate ingredient. Typically, lightweight concrete is cast into a mold, and two of the resulting molded elements are adhesively secured together to form a building element. The finished elements include horizontal and vertical channels which, at a building site, are filled with grout and rebar. That is, rebar elements are inserted into the channels and the channels are then filled with grout, which is typically "common" cement with its rock or gravel aggregate.

Half elements are molded with half channels in them, and two symmetrical half elements are then appropriately adhesively secured together, leaving the open channels extending horizontally and vertically.

The apparatus of the present invention measures styrene aggregate volumetrically and the styrene is conveyed to a main mixing unit where it mixes with a slurry which includes cement and water. The cement is weighed, and the water is measured volumetrically. Both fresh and recycled water is used.

The recycled water is water that has been used to wash and clean molds after the half elements have been separated or moved from the molds onto pallets for curing. The recycled water thus contains some cement, but the amount is relatively insignificant with respect to the overall mixing process.

After the half elements have been cured, they are adhesively secured together, and then the finished elements are appropriately trimmed. The scrap from the trimming is recycled. The scrap contains styrene along with hydrated cement. In the present invention, the styrene is separated from the hydrated cement, and the styrene is reutilized. The hydrated cement may be more nearly accurately referred to as cement dust, and may, if desired, be used as an aggregate.

Figure 1:
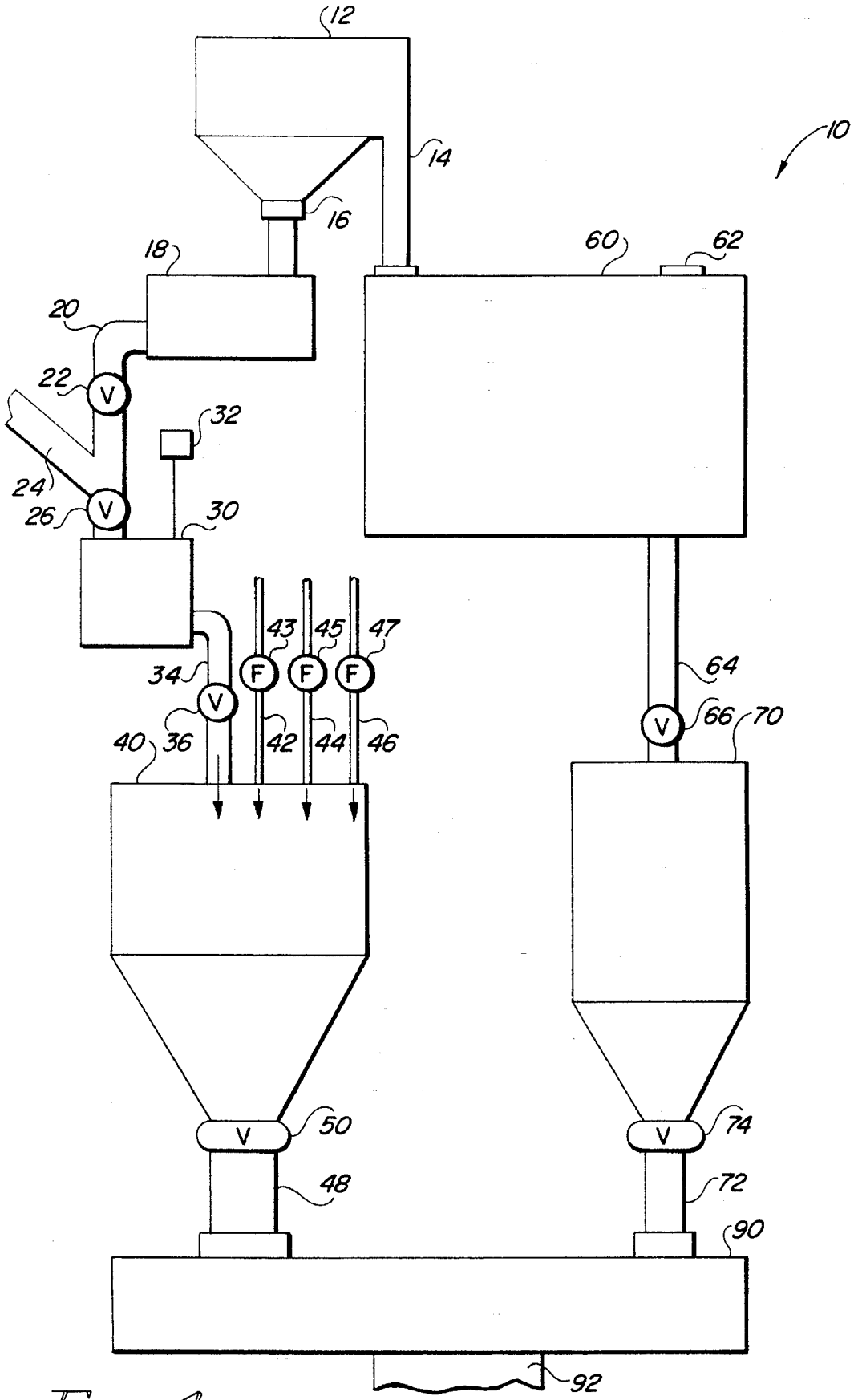
FIG. 1 comprises a schematic representation of the apparatus of the present invention.

FIG. 1 comprises a schematic representation of mixing apparatus 10 of the present invention. The scrap material, as discussed above, is fed into a trommel 12. The trommel 12 separates the styrene from the cement dust or hydrated cement. The styrene then is moved through a conduit 14 to a styrene storage hopper 60. The hydrated cement, or cement dust, flows from the trommel 12 through a conduit 16 to an aggregate storage chamber or hopper 18. That is, the hydrated cement or cement dust is merely now an aggregate material and is considered such in the hopper 18.

A conduit 20 extends from the aggregate storage chamber or hopper 18 to a weight hopper 30. A valve 22 in the conduit 20 controls the flow of the hydrated cement or cement dust in the conduit 20 to the weight hopper 30.

Fresh cement flows through a conduit 24 to the conduit 20. The conduit 24 connects to the conduit 20 downstream or below the valve 22. A valve 26 adjacent to the weight hopper 30 controls the flow of the fresh cement from the conduit 24, and any aggregate or cement dust through the valve 22 in the conduit 20, to the weight hopper 30.

A load cell 32 is used to weigh the cement elements in the weight hopper 30. The load cell 32 is a standard load cell, well known and understood in the art.

A conduit 34 extends from the weight hopper 30 to a slurry mixer 40. A valve 36 in the conduit 34 controls the flow of the cement materials, which may include both the fresh cement and the cement dust aggregate, from the weight hopper 30 through the conduit 34 and into the slurry mixer 40.

Three other lines or conduits also extend to the slurry mixer 40. These lines or conduits include a fresh water line or conduit 42, a recycled water line or conduit 44, and an additive line or conduit 46. Each of the lines or conduits 42, 44, and 46 includes its own valve, not shown, for controlling their respective flows to the slurry mixer 40.

Flow meters 43, 45 and 47 are schematically illustrated in FIG. 1 in each of the lines or conduits 42, 44, and 46, respectively. The flow meters are used for volumetrically measuring the fresh water in the conduit 42, the recycled water in the conduit 44, and additives in the conduit 46.

The water, cement, and additives, as required, or as desired, are appropriately blended in the slurry mixer 40. The slurry mixer 40 is also an element well known and understood in the art.

A conduit 48 extends from the slurry mixer 40 to a main mixing unit 90. Flow from the slurry mixer 40 in the conduit 48 is controlled by a valve 50.

From the storage hopper 60, as discussed above, a conduit 64 extends to a styrene or aggregate hopper 70. A valve 66 in the conduit 64 controls the flow of the styrene from the hopper 60 to the styrene hopper 70. The styrene in the styrene hopper 70 is measured volumetrically. The hopper itself may be of a predetermined size, volumetrically, so that when it is filled, the predetermined volume is reached. The hopper may thus serve two functions, one function is to merely hold the styrene aggregate and the other function is to volumetrically measure the styrene. Other types of volumetric measurement may also be used. Such volumetric measuring elements are well known and understood.

A conduit 72 extends from the styrene hopper 70 to the main mixing unit 90. A valve 74 controls the flow of the styrene from the hopper 70 to the main mixing unit 90.

It will be understood that the elements or materials in the main mixing unit 90 are measured separately, with the cement materials, both the fresh cement and the cement dust aggregate, being measured by weight, and the water and additive materials being measured volumetrically. Similarly, the styrene from the hopper 70 is likewise measured volumetrically.

The main mixing unit 90 then mixes the various materials as controlled by volume and weight, as discussed above.

From the main mixing unit 90, lightweight cement material 96 flows from the unit 90 through a conduit 92 into appropriate molds, as discussed below. As discussed above, the lightweight concrete material is moved from the molds onto appropriate curing pallets until the half elements have cured sufficiently to allow the half elements to be adhesively secured together to form a finished element. The finished elements are then moved to construction sites for construction into buildings.

Figure 2A:
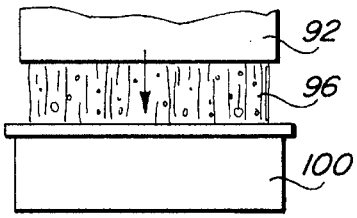
FIGS. 2A, 2B, and 2C schematically illustrate the sequential forming of a half block of lightweight cement/concrete product from the apparatus of the present invention.

FIG. 2A comprises a schematic representation of the conduit 92 disposed over a mold 100. The mold 100 is shown being filled with the mixed lightweight cement/concrete material or mixture indicated by reference numeral 96 from the conduit 92.

Figure 2B:
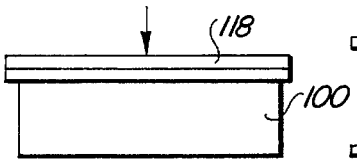
Figure 2C:
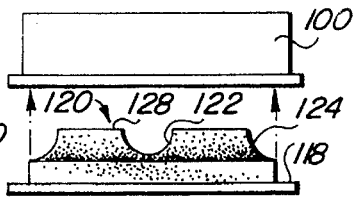

FIGS. 2B and 2C are consecutive illustrations following FIG. 2A. In FIG. 2B, a pallet 118 is disposed on the mold 100 after the mold 100 is filled with the lightweight concrete mixture 96, as shown in FIG. 2A. With the pallet 118 on top of the mold 100, the mold 100 is then inverted, and appropriate pressure is applied to both the mold 100 and the pallet 118 to compress the lightweight concrete mixture 96 disposed in the mold. The mold 100 is inverted so that the pallet becomes the bottom support for a formed half element 120.

In FIG. 2C, the half element 120 is shown disposed on the pallet 118, with the mold 100 lifted off the half element 120. The half element 120 is shown with a longitudinally extending half channel 122 centered in the block 110 and quarter channels 124 at the sides of the half element 120 generally parallel to the longitudinal half channel 122.

Figure 4:
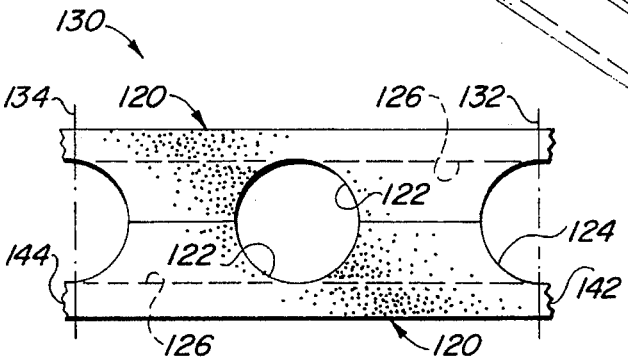
FIG. 4 comprises an end view of a finished lightweight concrete block.

The longitudinal channel 122 comprises a half channel which, when a second half element 120 is appropriately secured to the element 120 in a facing manner, as illustrated in FIG. 4, a circular channel 112 extends longitudinally through the completed element. The channels 124 then become half channels, as discussed in more detail in conjunction with FIG. 4, below.

Figure 3:
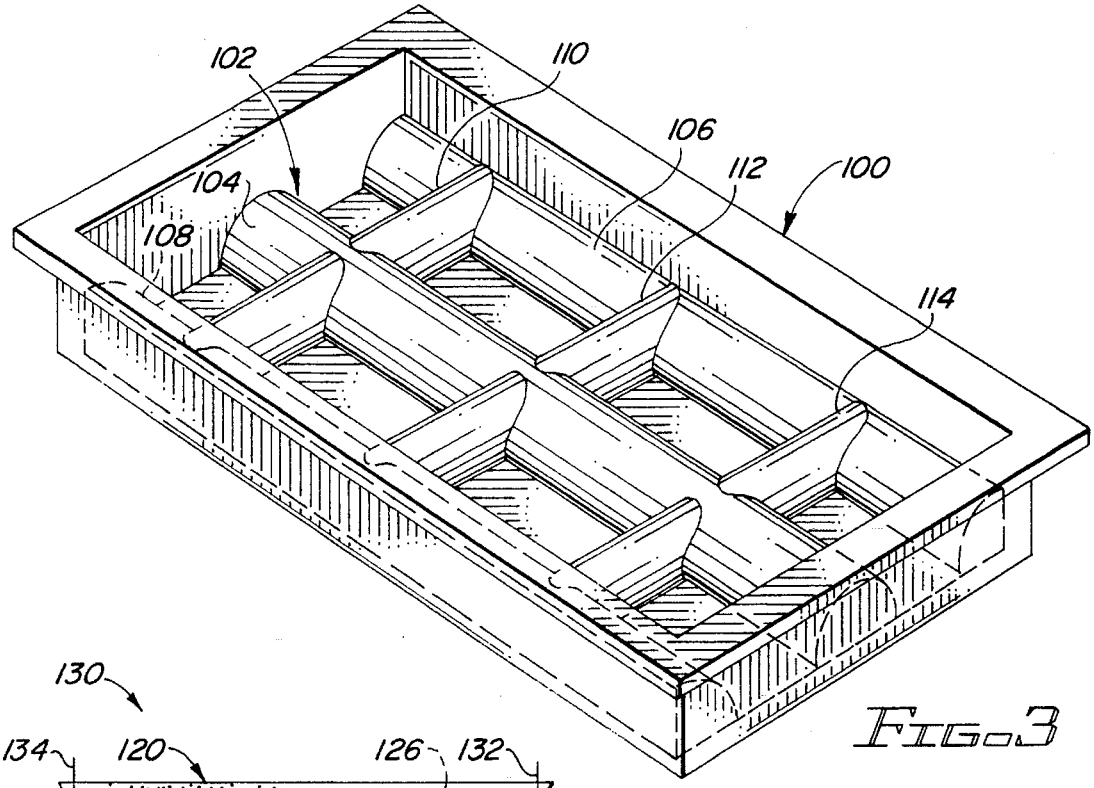
FIG. 3 comprises a perspective view of a mold used with the apparatus of the present invention.

FIG. 3 comprises a perspective view of the mold 100, showing a mold insert 102 which includes the elements which form the longitudinal half channel 122 and the longitudinal quarter channels 124, and a plurality of transverse half channels.

The mold elements include a center longitudinal element 104, a pair of longitudinally extending elements 106 and 108, which are generally parallel to the mold element 104, and three transverse mold elements 110, 112, and 114. The elements 110, 112, and 114 form a plurality of transverse channels 126, shown in FIG. 4.

After the mold 100 has been removed from the uncured half element 120, the mold is cleaned by spraying it with water. The water used in the washing is recycled into the mix, as indicated above, and as will be discussed below in conjunction with FIG. 5. The bottom of the mold insert 104 between the various mold elements provides a top planar surface 128 on a half element. The top planar surfaces 128 of two half elements are joined together, as discussed below.

When the mold 100 is removed, the half element 120 is then left on a pallet 118 for curing.

At such time as a plurality of half elements 120 are cured sufficiently, an adhesive is placed on the planar surfaces 128 of the half elements 120 and two half elements 120 are mated together, with the respective half channels 122 and outer channels 124 facing each other in an opposing alignment relationship. Thus, two half elements 120 are formed into a single block 130, as shown in FIG. 4, with circular longitudinal and transverse chambers disposed therein and which chambers then receive rebar and common or ordinary cement, as discussed above.

FIG. 4 comprises an end view of two half elements 120, appropriately secured together, to define a single element 130. For dimensional accuracy, the width of the molds 100 is slightly larger than the desired finished product. The excess material is appropriately sawed or cut away along the lines 132 and 134, with the resulting scrap material 142 and 144 being recycled for appropriate separation in the trommel 12, as discussed above.

The scraps 142 and 144 are fed into the trommel 12 for separation of the styrene and the hydrated cement dust. As indicated above, the used or scrap styrene flows from the trommel 12 through the conduit 14 to the storage hopper 60, while the hydrated cement dust flows from the trommel 12 in the conduit 16 to the aggregate storage chamber or hopper 18.

Figure 5:
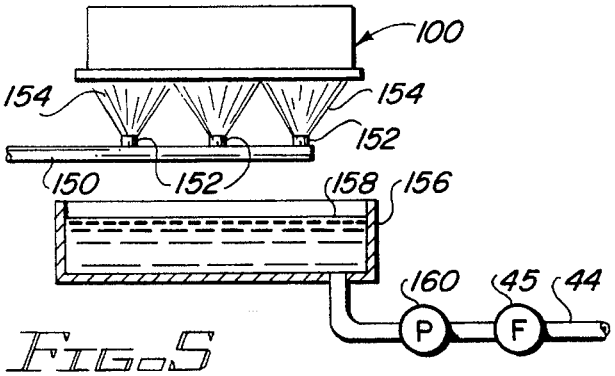
FIG. 5 comprises a schematic representation of a portion of the present invention.

FIG. 5 comprises a schematic representation of a mold 100, after it has been lifted from the element 120, as for example in FIG. 2C, and the use of water to clean the mold prior to reusing the mold.

A water supply conduit 150 is shown disposed beneath the inverted mold 100, with a plurality of nozzle elements 152 secured to the water supply line or conduit 150. Water spray 154 emanates from the nozzles 152 and is directed into the interior of the mold 100 to clean the mold. The water from the mold 100 then falls downwardly into a sump 156.

Within the sump 156 is water 158. The water 158 comprises the water collected from the cleaning of the molds and is to be recycled. The water 158 includes water and cement elements, etc., from the mold 100.

The recycled water 158 then flows in the conduit 44 to the slurry mixer 40, as shown in FIG. 1.

In FIG. 5, a pump 160 and a flow meter 162 are shown in the conduit 44. The pump 160 pumps the recycled water 158, and the flow meter 162 volumetrically measures the pumped recycled water.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Mixing apparatus comprising in combination:

a first hopper for receiving cement material;

means for weighing the cement material in the first hopper;

a first mixer for receiving and mixing the cement material from the first hopper;

means for providing a flow of water to the first mixer to be mixed with the cement material;

means for measuring the volume of the flow of water to be mixed with the cement material in the first mixer;

a second hopper for receiving aggregate material;

means for measuring the volume of the aggregate material in the secured hopper;

a second mixer for receiving the mixed cement material and water from the first mixer through a first inlet and for receiving the aggregate material from the second hopper through a second inlet and for mixing the aggregate material and the cement material and water.

2. The apparatus of claim 1 which further includes a third hopper for receiving aggregate material and a conduit from the third hopper to the second hopper by which the aggregate material moves from the third hopper to the second hopper.

3. The apparatus of claim 2 which further includes means for receiving scrap material and separating the scrap material into scrap cement material and scrap aggregate material wherein the means for receiving scrap cement material is in communication with the first hopper and the third hopper.

4. The apparatus of claim 3 which further includes means for conveying the scrap aggregate material to the third hopper.

5. The apparatus of claim 3 which further includes a fourth hopper for receiving the separated scrap cement material from the means for receiving scrap material.

6. The apparatus of claim 5 which further includes means for conveying the scrap cement material to the first hopper.

7. The apparatus of claim 1 which further includes a mold for receiving mixed cement material, aggregate material and water from the second mixer.

8. The apparatus of claim 7 which further includes a pallet for receiving the mixed cement and aggregate material from the mold and on which the cement and aggregate material may cure.

9. The apparatus of claim 8 which further includes means for cleaning the mold with water after the cement and aggregate material is moved onto the pallet.

10. The apparatus of claim 9 which further includes a sump for receiving the water used to clean the mold and for storing the water for reuse.

11. The apparatus of claim 10 which further includes means for conveying the water from the sump to the first mixer for reusing the water.

* * * * *